US011330917B2

(12) United States Patent
Nichols

(10) Patent No.: US 11,330,917 B2
(45) Date of Patent: May 17, 2022

(54) NURSING CHAIR HAVING AN ADJUSTABLE ARM

(71) Applicant: Marissa Nichols, Meeker, CO (US)

(72) Inventor: Marissa Nichols, Meeker, CO (US)

( * ) Notice: Subject to any disclaimer, the term of this patent is extended or adjusted under 35 U.S.C. 154(b) by 0 days.

(21) Appl. No.: 17/152,052

(22) Filed: Jan. 19, 2021

(65) Prior Publication Data

US 2021/0227995 A1 Jul. 29, 2021

Related U.S. Application Data

(60) Provisional application No. 62/966,302, filed on Jan. 27, 2020.

(51) Int. Cl.

| | |
|---|---|
| ***A47C 1/00*** | (2006.01) |
| ***A47C 7/54*** | (2006.01) |
| ***A47D 13/08*** | (2006.01) |
| ***A47C 7/40*** | (2006.01) |

(52) U.S. Cl.

CPC ..... *A47D 13/083* (2013.01); *A47C 7/40* (2013.01); *A47C 7/541* (2018.08); *A47C 7/543* (2013.01)

(58) Field of Classification Search

CPC ..... A47C 1/11; A47D 13/083
USPC ..... 297/251, 411.3, 411.31, 411.36, 411.37, 297/411.34

See application file for complete search history.

(56) References Cited

U.S. PATENT DOCUMENTS

| | | | | | |
|---|---|---|---|---|---|
| 355,230 | A * | 12/1886 | Taliaferro | A47D 13/083 | 297/170 |
| 1,403,543 | A * | 1/1922 | Daniel | A47D 13/083 | 312/235.5 |
| 2,714,923 | A * | 8/1955 | Carothers | A47D 1/103 | 297/251 |
| 4,779,883 | A * | 10/1988 | Paduano | A61G 5/10 | 297/251 X |
| 5,720,520 | A * | 2/1998 | Bengtson | A47D 1/10 | 297/251 X |
| 7,445,280 | B2 * | 11/2008 | Stoline-Litwin | A47C 7/62 | 160/335 |
| 7,490,910 | B1 * | 2/2009 | Draughon | A47C 1/03 | 297/411.31 X |
| 2002/0070598 | A1 | 6/2002 | Perl | | |
| 2006/0055215 | A1 * | 3/2006 | Potosky | A47C 7/546 | 297/219.1 |
| 2007/0029850 | A1 * | 2/2007 | Weng | A47C 7/70 | 297/161 |
| 2013/0091633 | A1 * | 4/2013 | Garofalo | A47D 15/005 | 5/655 |
| 2020/0100594 | A1 * | 4/2020 | Fietz | A47C 1/0307 | |

FOREIGN PATENT DOCUMENTS

| | | | | | |
|---|---|---|---|---|---|
| CN | 106333538 | A * | 1/2017 | A47D 13/083 | |
| JP | 2018015640 | A * | 2/2018 | A47D 13/083 | |
| KR | 2020097603 | A * | 8/2020 | A47D 13/083 | |

* cited by examiner

*Primary Examiner* — Rodney B White

(74) *Attorney, Agent, or Firm* — Faegre Drinker Biddle & Reath LLP

(57) ABSTRACT

A nursing chair includes a seat and one or more adjustable armrests for supporting an infant. The adjustable armrests are repositionably movable in various directions to suitably position the infant and facilitate comfort of a mother and the infant during breastfeeding. The nursing chair may also include a privacy screen for selectively obscuring the mother and/or infant.

11 Claims, 12 Drawing Sheets

NURSING CHAIR HAVING AN ADJUSTABLE ARM

CROSS-REFERENCE TO RELATED APPLICATION

The present application claims the benefit of and priority to U.S. Provisional Application Ser. No. 62/966,302, filed on Jan. 27, 2020, which is hereby incorporated herein by reference in its entirety for all that it teaches and for all purposes.

FIELD OF THE DISCLOSURE

The present disclosure relates generally to a chair having one or more adjustable armrests. In particular, the present disclosure relates to a chair, such as a nursing chair, configured to support an infant with a repositionable armrest an provide comfort for the nursing mother.

BACKGROUND

Typical so-called nursing chairs include all-purpose gliders, recliners, rocking chairs, and the like. However, improved nursing chairs that provide comfort and security to both mother and infant are desirable.

SUMMARY

The present disclosure relates generally to nursing chairs. In one aspect, the present disclosure provides a chair having a seat and one or more adjustable armrests for supporting an infant. The adjustable armrests are repositionably movable in various directions to suitably position the infant and facilitate comfort of a mother and the infant during breastfeeding. In some embodiments, the nursing chair also includes a privacy screen for selectively obscuring the mother and/or infant.

In an illustrative embodiment, a nursing chair according to the present disclosure includes a seat portion configured to support a mother and a back portion coupled to the seat portion. The nursing chair further includes an adjustable armrest portion coupled to the seat portion. The adjustable armrest portion is movable from a normal position to an infant supporting position and vice versa relative to the seat portion. In the normal position an upper surface of the adjustable armrest portion is configured to support an arm of the mother. In the infant supporting position a side surface of the adjustable armrest portion adjacent the upper surface is configured to support the infant.

These and other advantages will be apparent from the disclosure of the aspects and configurations contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The terms "up," "upper," and "upward," and variations thereof, are used for clarity and are only intended to refer to a relative direction (that is, a certain direction that is to be distinguished from another direction), and are not meant to be interpreted to mean an absolute direction. Similarly, the terms "down," "lower," and "downward," and variations thereof, are used for clarity and are only intended to refer to a relative direction that is at least approximately opposite a direction referred to by one or more of the terms "up," "upper," and "upward," and variations thereof. A "plurality" means more than one.

It should be understood that every maximum numerical limitation given throughout the present disclosure is deemed to include each and every lower numerical limitation as an alternative, as if such lower numerical limitations were expressly written herein. Every minimum numerical limitation given throughout the present disclosure is deemed to include each and every higher numerical limitation as an alternative, as if such higher numerical limitations were expressly written herein. Every numerical range given throughout the present disclosure is deemed to include each and every narrower numerical range that falls within such broader numerical range, as if such narrower numerical ranges were all expressly written herein.

As used herein in association with values (for example, terms of magnitude, measurement, and/or other degrees of qualitative and/or quantitative observations that are used herein with respect to characteristics (for example, dimensions, measurements, attributes, components, etc.) and/or ranges thereof, of tangible things (for example, products, inventory, etc.) and/or intangible things (for example, data, electronic representations of currency, accounts, information, portions of things (for example, percentages, fractions), calculations, data models, dynamic system models, algorithms, parameters, etc.), "about" and "approximately" may be used, interchangeably, to refer to a value, configuration, orientation, and/or other characteristic that is equal to (or the same as) the stated value, configuration, orientation, and/or other characteristic or equal to (or the same as) a value, configuration, orientation, and/or other characteristic that is reasonably close to the stated value, configuration, orientation, and/or other characteristic, but that may differ by a reasonably small amount such as will be understood, and readily ascertained, by individuals having ordinary skill in the relevant arts to be attributable to measurement error; differences in measurement and/or manufacturing equipment calibration; human error in reading and/or setting measurements; adjustments made to optimize performance and/or structural parameters in view of other measurements (for example, measurements associated with other things); particular implementation scenarios; imprecise adjustment and/or manipulation of things, settings, and/or measurements by a person, a computing device, and/or a machine; system tolerances; control loops; machine-learning; foreseeable variations (for example, statistically insignificant variations, chaotic variations, system and/or model instabilities, etc.); preferences; and/or the like.

The preceding is a simplified summary to provide an understanding of some aspects of the disclosure. This summary is neither an extensive nor exhaustive overview of the disclosure and its various aspects and configurations. It is intended neither to identify key or critical elements of the disclosure nor to delineate the scope of the disclosure but to present selected concepts of the disclosure in a simplified form as an introduction to the more detailed description presented below. As will be appreciated, other aspects and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects and configurations of the disclosure, as illustrated by the drawings referenced below.

DETAILED DESCRIPTION

Figure 1:
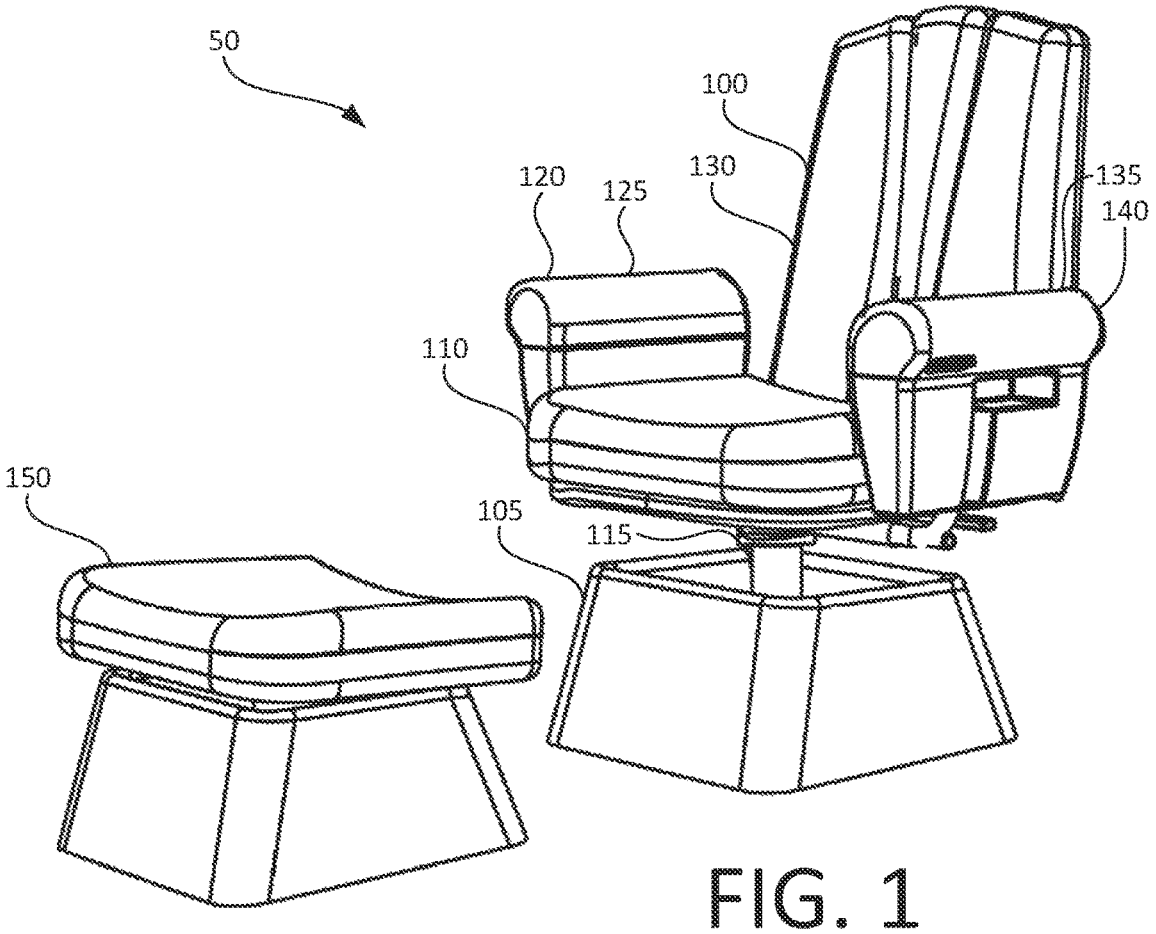
FIG. 1 illustrates a perspective view of a nursing chair system according to an aspect of the present disclosure.
Figure 2:
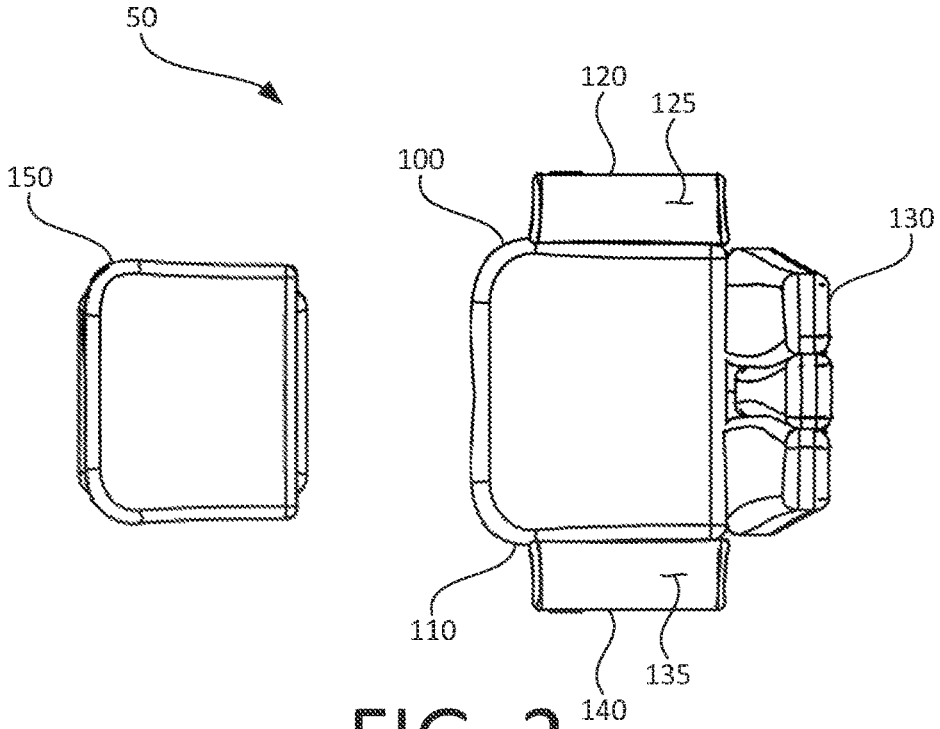
FIG. 2 illustrates a top view of the chair system of FIG. 1.
Figure 3:
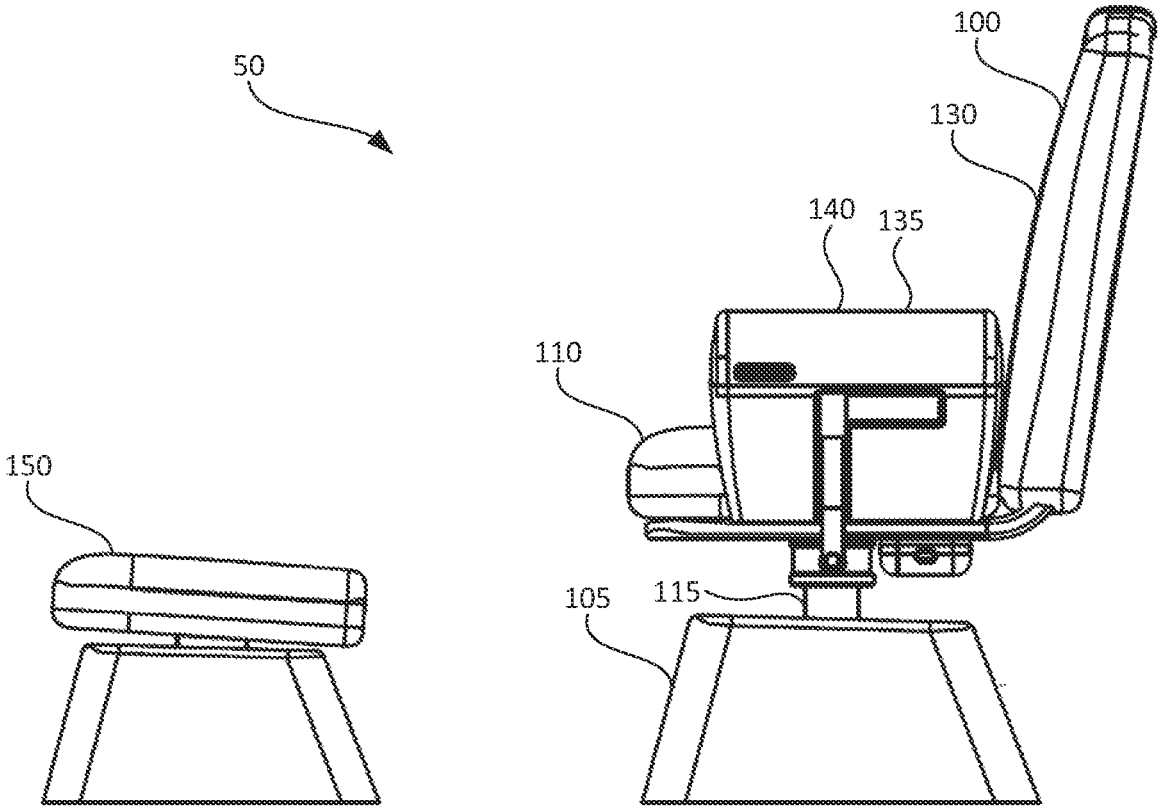
FIG. 3 illustrates a side view of the chair system of FIG. 1.
Figure 4:
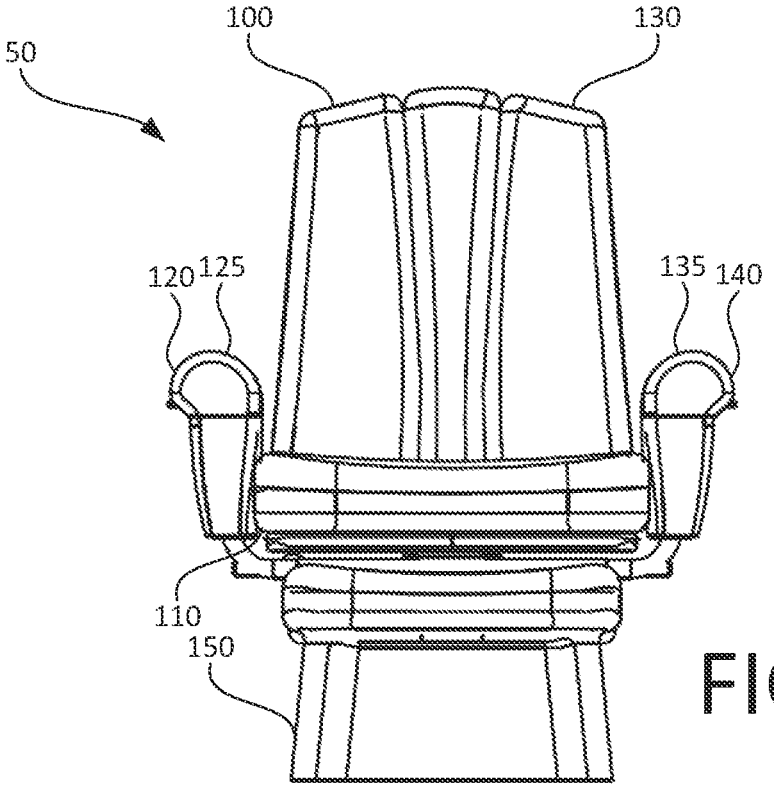
FIG. 4 illustrates a front view of the chair system of FIG. 1.
Figure 5:
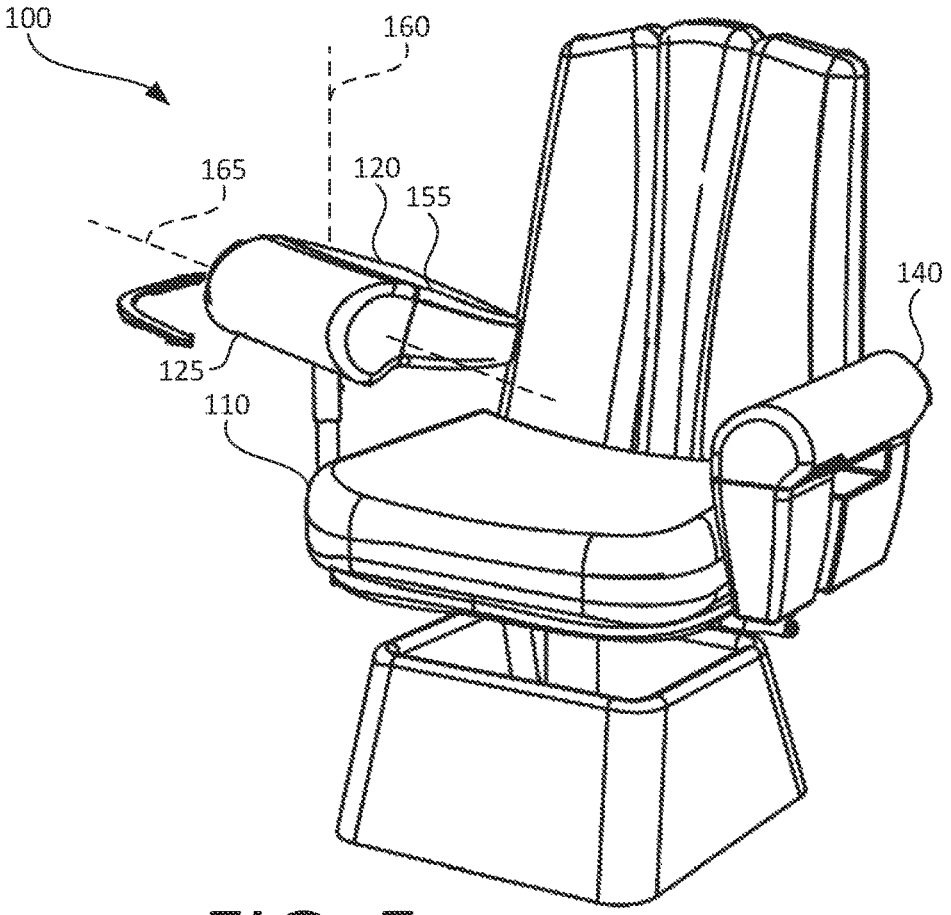
FIG. 5 illustrates a perspective view of a chair the system of FIG. 1 with an adjustable armrest in a nursing position.
Figure 6:
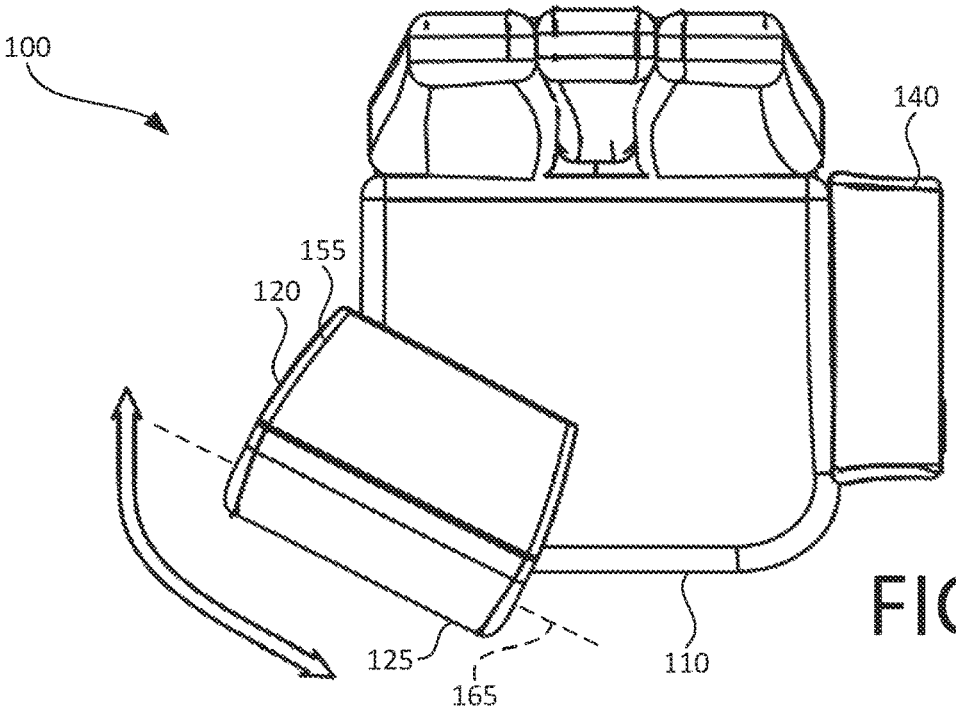
FIG. 6 illustrates a top view of the chair of FIG. 5 with the adjustable armrest in the nursing position.
Figure 8:
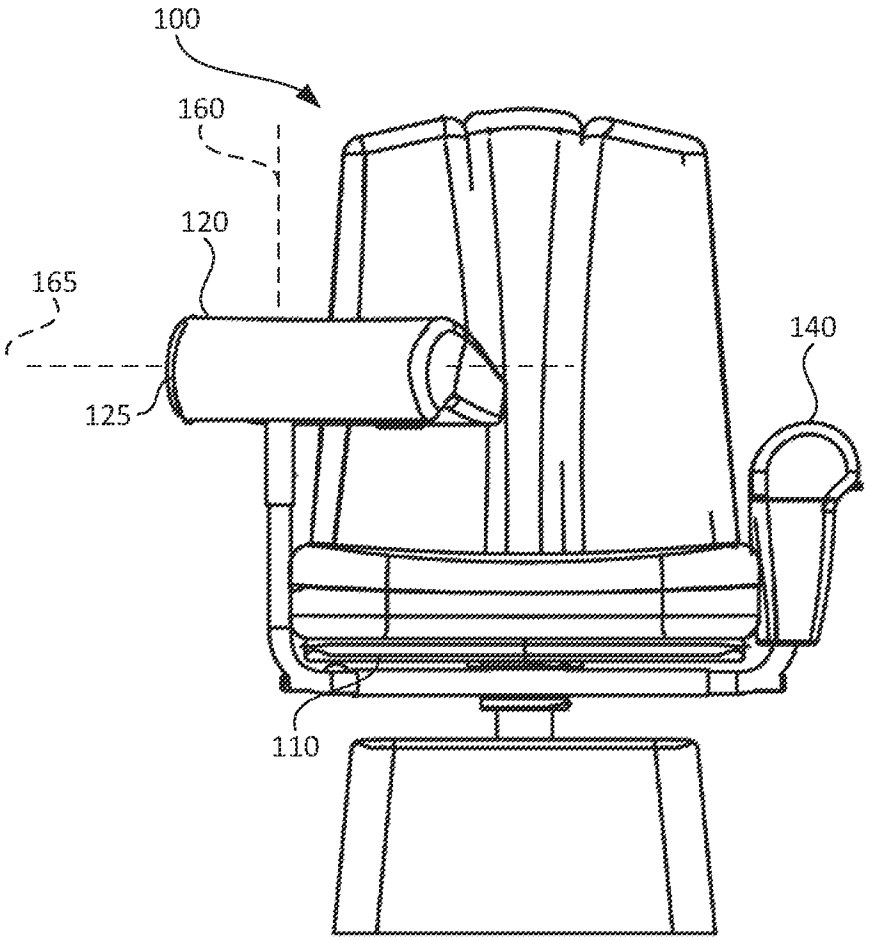
FIG. 8 illustrates a front view of the chair of FIG. 5 with the adjustable armrest in the nursing position.
Figure 7:
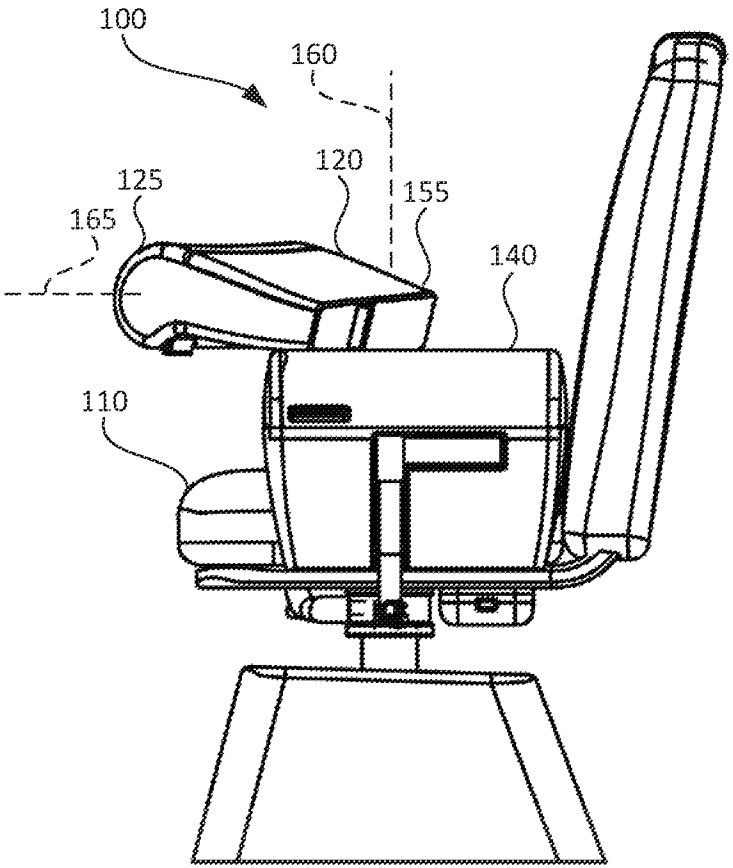
FIG. 7 illustrates a side view of the chair of FIG. 5 with the adjustable armrest in the nursing position.

Persons skilled in the art will readily appreciate that various aspects of the present disclosure can be realized by any number of methods and apparatus configured to perform the intended functions. It should also be noted that the accompanying drawing figures referred to herein are not necessarily drawn to scale but may be exaggerated to illustrate various aspects of the present disclosure, and in that regard, the drawing figures should not be construed as limiting.

FIGS. 1-4 illustrate a nursing chair system 50 according to an embodiment of the present disclosure. Generally, the nursing chair system 50 includes a nursing chair 100 and a footrest 150. The chair 100 is configured to support a seated adult human, that is, an infant's mother, in a seat portion 110 (also interchangeably referred to herein as a seat 110). The seat portion 110 is rotatably coupled to a pedestal portion 105 about a vertical axis (not shown). As such, the seat portion 110 is rotatable, by 360 degrees, relative to the pedestal portion 105 about the vertical axis. The pedestal portion 105 includes a lifting mechanism 115 (for example, a pneumatically-driven actuator or an electrically-driven actuator) for raising and/or lowering seat portion 110. The seat portion 110 is also adjacent to a first, or right, armrest portion 120, a back portion 130, and a second, or left, armrest portion 140. In some embodiments and as illustrated, the first armrest portion 120 and second armrest portion 140 have like features and/or are mirror images of each other. More specifically, the first armrest portion 120 and the second armrest portion 140 may both be adjustable to facilitate nursing an infant on either of a mother's breasts. In other embodiments, the first armrest portion 120 and second armrest portion 140 have different features than each other. More specifically, one of the first armrest portion 120 and the second armrest portion 140 is adjustable, and the other of the first armrest portion 120 and the second armrest portion 140 is not adjustable.

FIGS. 1-4 illustrate the chair 100 with the first armrest portion 120 and the second armrest portion 140 in first, or "resting" or "normal", positions. In such positions, the first armrest portion 120 and the second armrest portion 140 are generally positioned perpendicularly relative to the seat portion 110 and the back portion 130. Further, in such positions a first upper surface 125 and a second upper surface 135 of the first armrest portion 120 and the second armrest portion 140, respectively, are configured to support an arm (more specifically, an elbow and/or forearm) of a mother seated in the chair 100.

FIGS. 5-8 illustrate the chair 100 with the first armrest portion 120 in one of various second, or "infant support", positions. In the infant support positions, a first side surface 155, or an inner side surface 155, of the first armrest portion 120 is configured to support an infant thereon. More specifically, in the infant support positions the first side surface 155 is configured to support an infant such that the infant's head is generally disposed above the seat portion 110 and the infant's feet generally point away from the chair 100. In the infant support positions, the inner side surface 155 may be disposed, as illustrated, at a slight angle to a horizontal plane (for example, about 15 degrees, about 30 degrees, or about 45 degrees) or, alternatively, in the horizontal plane. In some embodiments, the first side surface 155 is cushioned and/or includes strap or harness (not shown) to facilitate comfort and/or securement, respectively, of an infant supported on the first side surface 155. To move to an infant support position, the first armrest portion 120 is translatable relative to the seat portion 110 along to a first, or vertical, axis 160, rotatable about the vertical axis 160 (for example, by about 45 degrees), rotatable about a second axis 165 substantially parallel to the first upper surface 125, and translatable along the second axis 165. Although it is not specifically illustrated, the second armrest portion 140 may similarly occupy various second, or infant support, positions and include similar components to facilitate supporting an infant in such positions.

Figure 9:
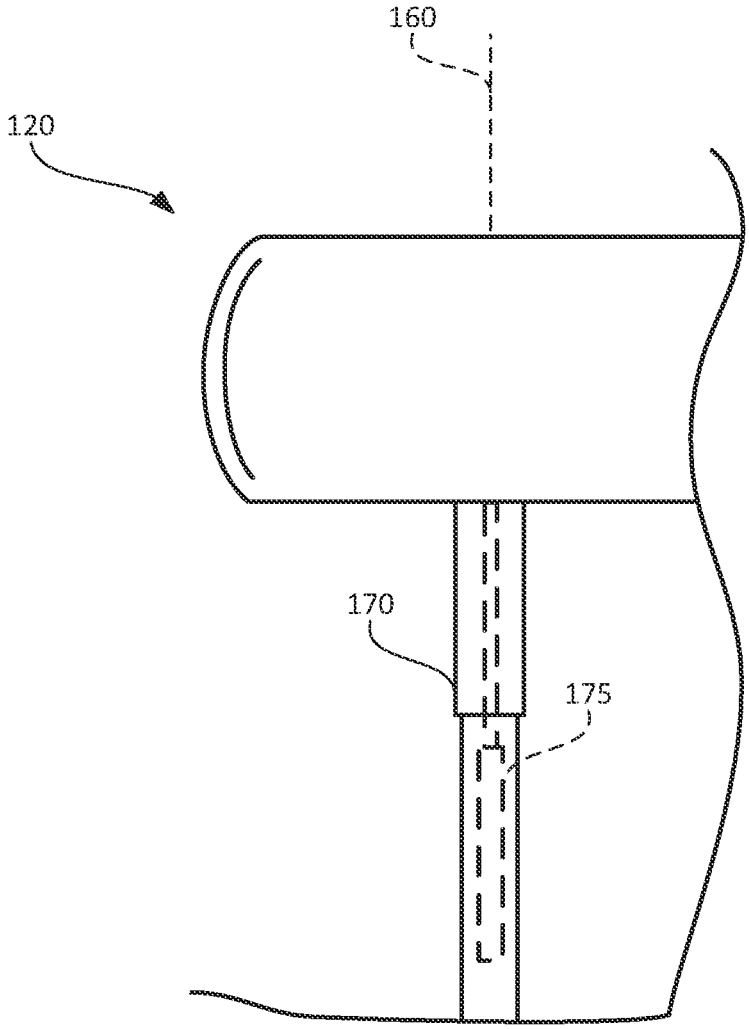
FIG. 9 illustrates a partial front view of the adjustable armrest of the chair of FIG. 5.

FIG. 9 partially illustrates the first armrest portion 120 and a first support 170 that couples the first armrest portion 120 to the seat portion 110 (shown elsewhere). The first support 170 is actuatable to translate the first armrest portion 120 relative to the seat portion 110 along the vertical axis 160. More specifically, the first support 170 is a telescoping structure that carries a linear actuator 175 (for example, an electrically-driven linear actuator). Alternatively, the first support 170 may take other forms. For example, the first support 170 may carry another type of linear actuator 175, such as a pneumatically-driven linear actuator. As another example, the first support 170 may take the form of a pair of slidable rails.

Figure 10:
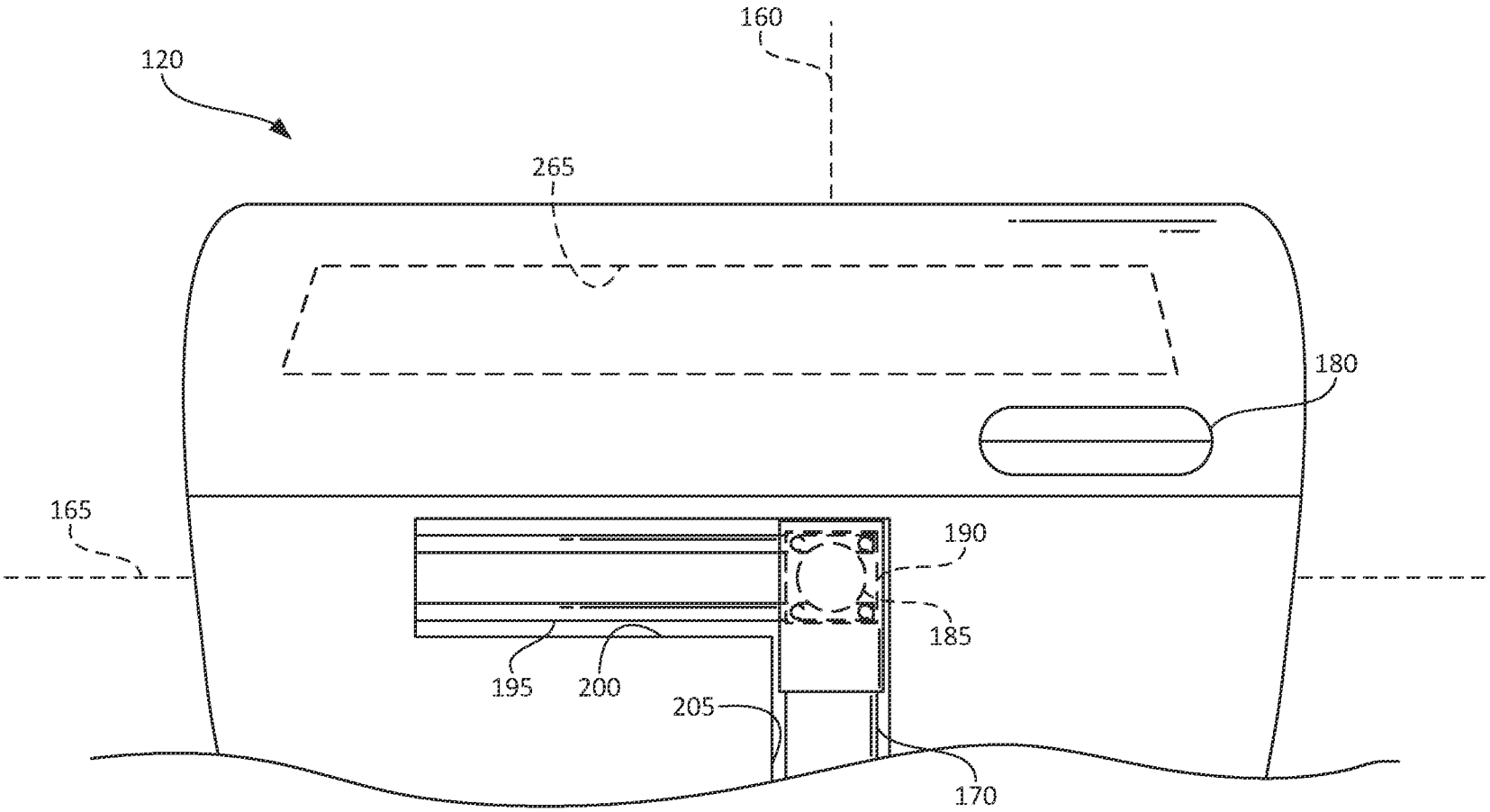
FIG. 10 illustrates a partial side view of the adjustable armrest of the chair of FIG. 5.
Figure 11:
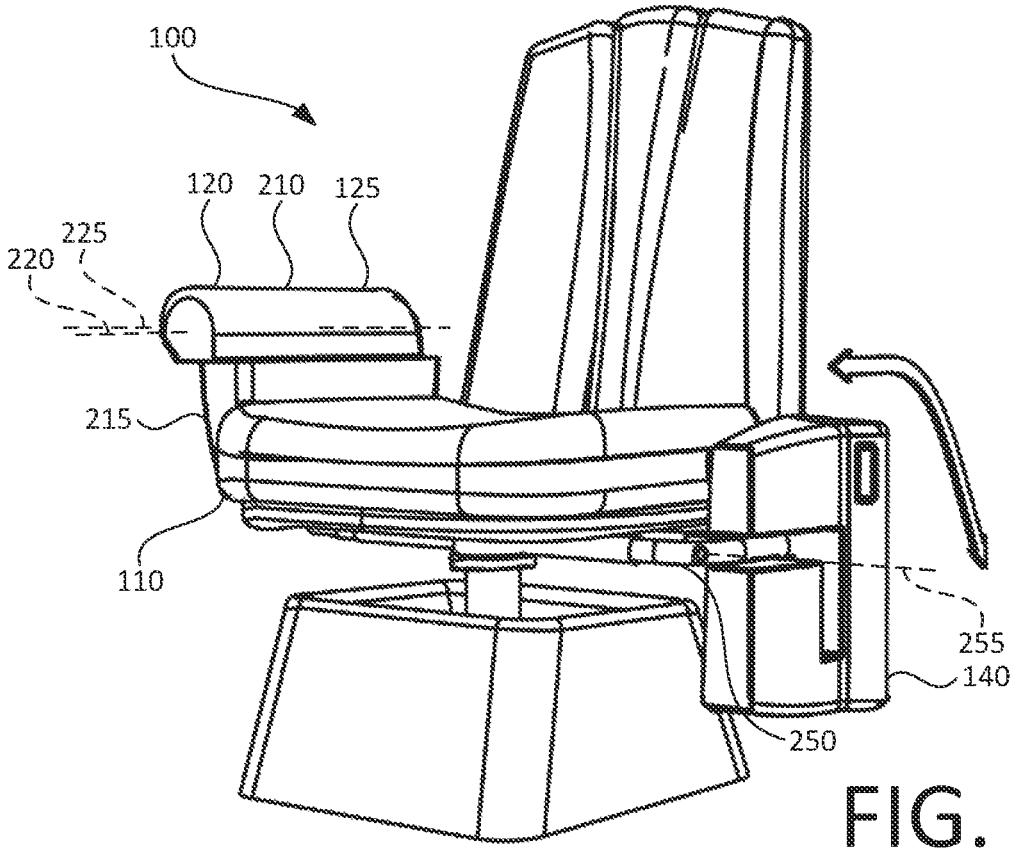
FIG. 11 illustrates a perspective view of the chair of the system of FIG. 1 with an adjustable armrest in a retracted position.
Figure 12:
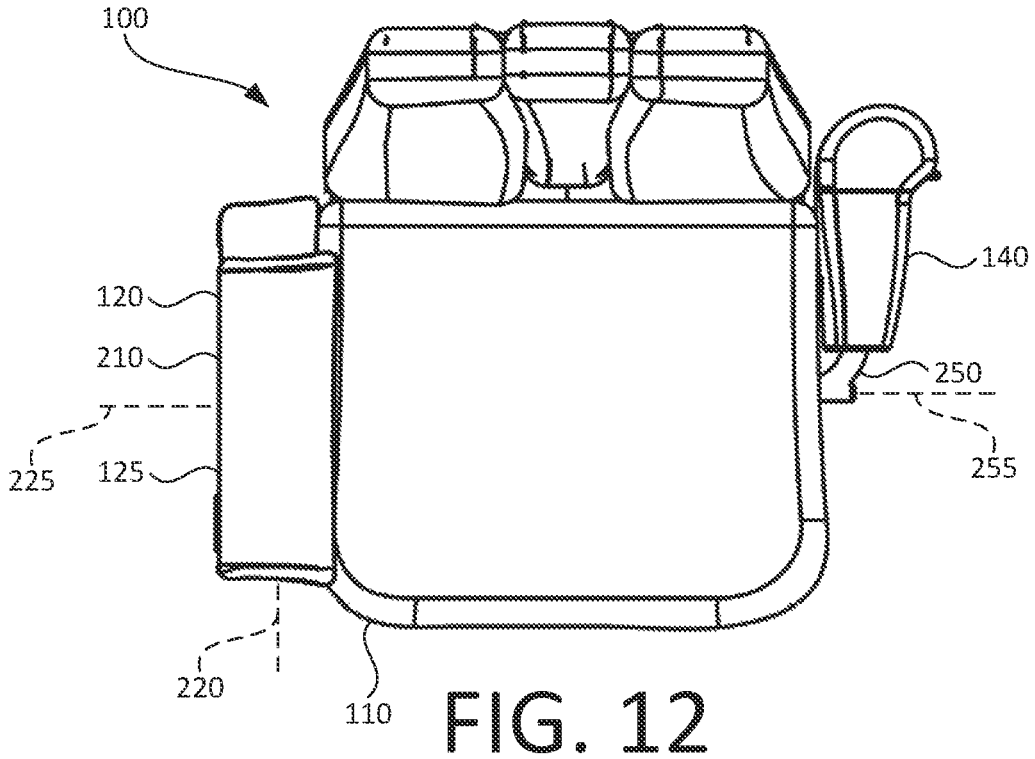
FIG. 12 illustrates a top view of the chair of FIG. 11 with the adjustable armrest in the retracted position.
Figure 14:
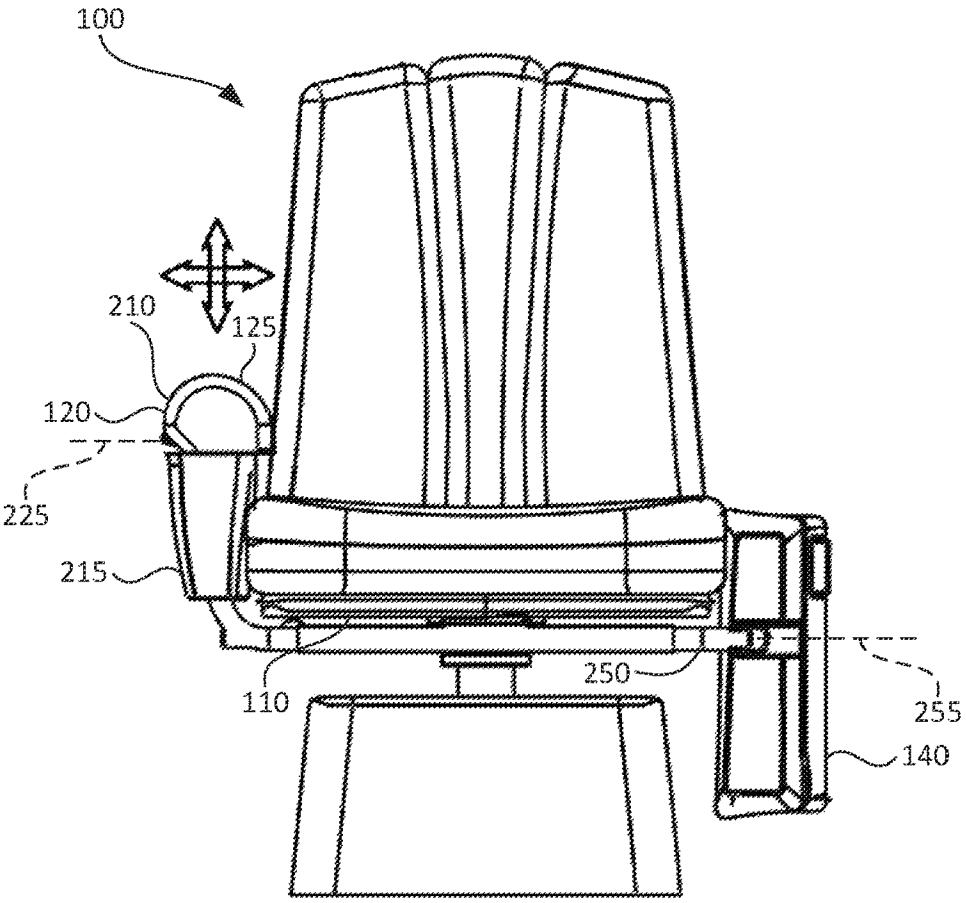
FIG. 14 illustrates a front view of the chair of FIG. 11 with the adjustable armrest in the retracted position.
Figure 13:
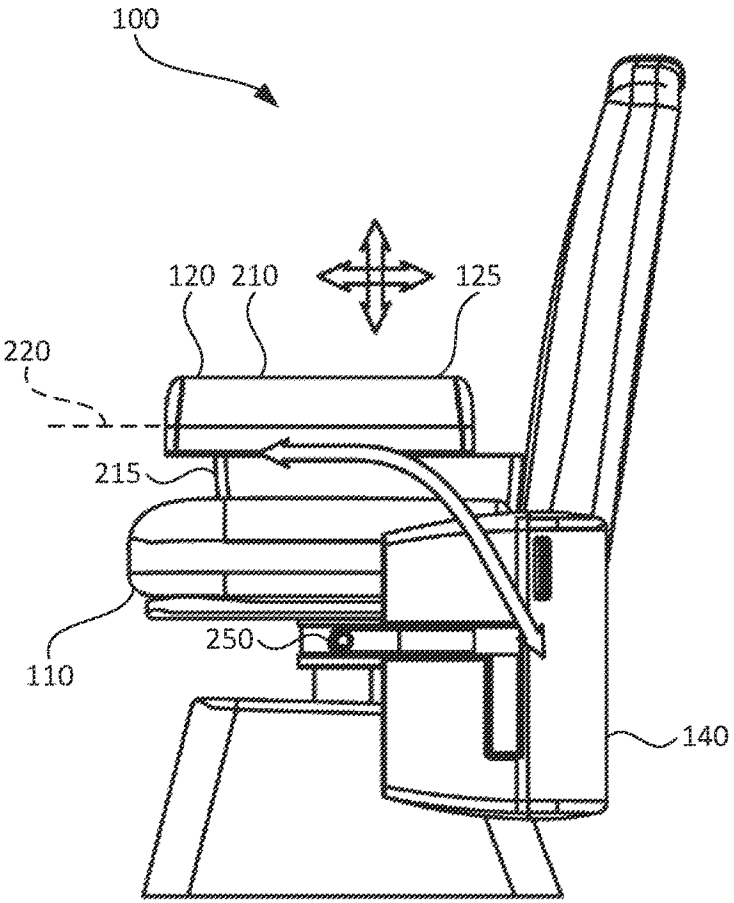
FIG. 13 illustrates a side view of the chair of FIG. 11 with the adjustable armrest in the retracted position.

FIG. 10 partially illustrates the first armrest portion 120 and components that facilitate moving the first armrest portion 120 from the normal position, as illustrated, to an infant support position. Specifically, FIG. 10 illustrates a first user input 180 (for example, a button or a lever) that is actuatable to energize the linear actuator 175 (shown elsewhere) of the first support 170 and thereby translate the first armrest portion 120 relative to the seat portion 110 (shown elsewhere) along the vertical axis 160. The first support 170 couples to a multiple degree-of-freedom joint 185, such as a ball joint, which in turn couples to the first armrest portion 120. The joint 185 permits the first armrest portion 120 to rotate relative to the first support 170 about the vertical axis 160 and the second axis 165. The joint 185 couples to the first armrest portion 120 via a slider 190 carried on a track 195, and the slider 190 is translatable along the track 195 to translate the first armrest portion 120 along the second axis 165. As illustrated, these components may be partially or fully recessed within the first armrest to provide a less conspicuous appearance. More specifically, the track 195, slider 190, and the joint 185 may be recessed in a horizontal channel 200 and the first support 170 may be partially recessed in a vertical channel 205 coupled to the horizontal channel 200. Alternatively, these components may be disposed externally from the first armrest portion 120.

FIGS. 11-14 illustrate the chair 100 with (1) the first armrest portion 120 in one of various third, or "adjustment", positions and (2) the second armrest portion 140 in a fourth, or "retracted", position. In the adjustment positions, an upper portion 210 of the first armrest portion 120, which includes the first upper surface 125, is moved relative to a lower portion 215 to facilitate providing support for a mother's arm in different seated positions (for example, leaning to one side, sitting completely upright, and the like). The upper portion 210 is movable relative to the lower portion 215 in a first, or front-to-back, direction 220 and a second, or side-to-side, direction 225.

Figure 15:
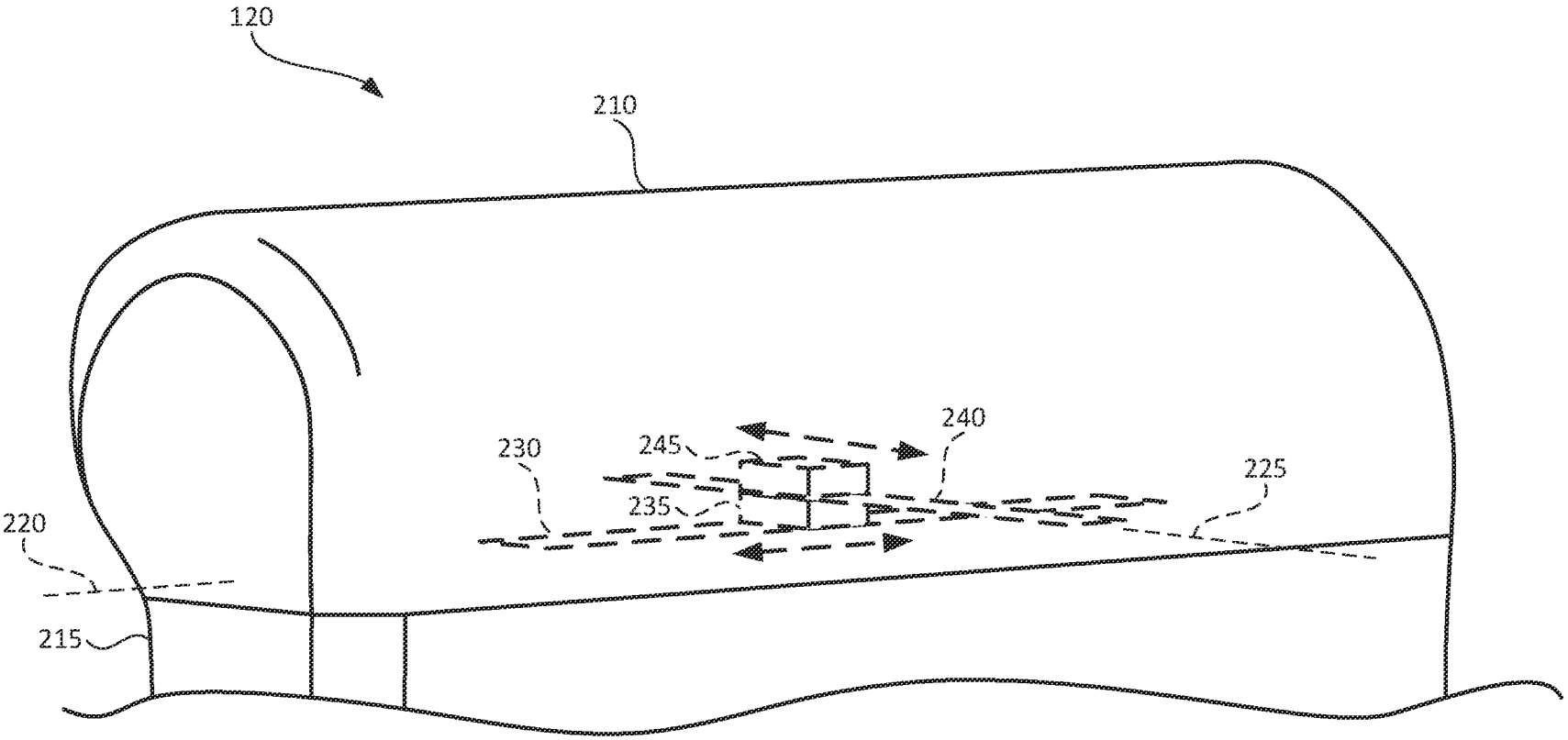
FIG. 15 illustrates a partial perspective view of the adjustable armrest of the chair of FIG. 5.
Figure 17:
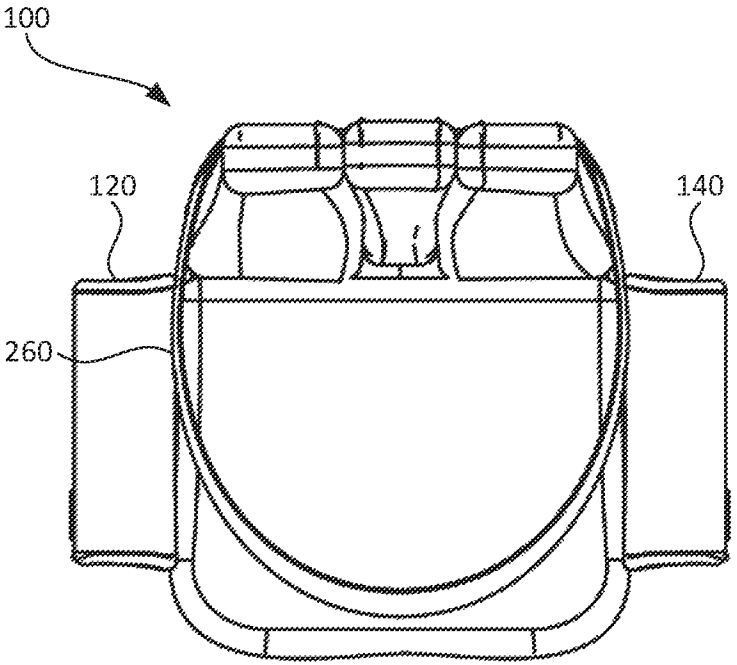
FIG. 17 illustrates a top view of the chair of FIG. 16 with the privacy screen in the privacy position.
Figure 16:
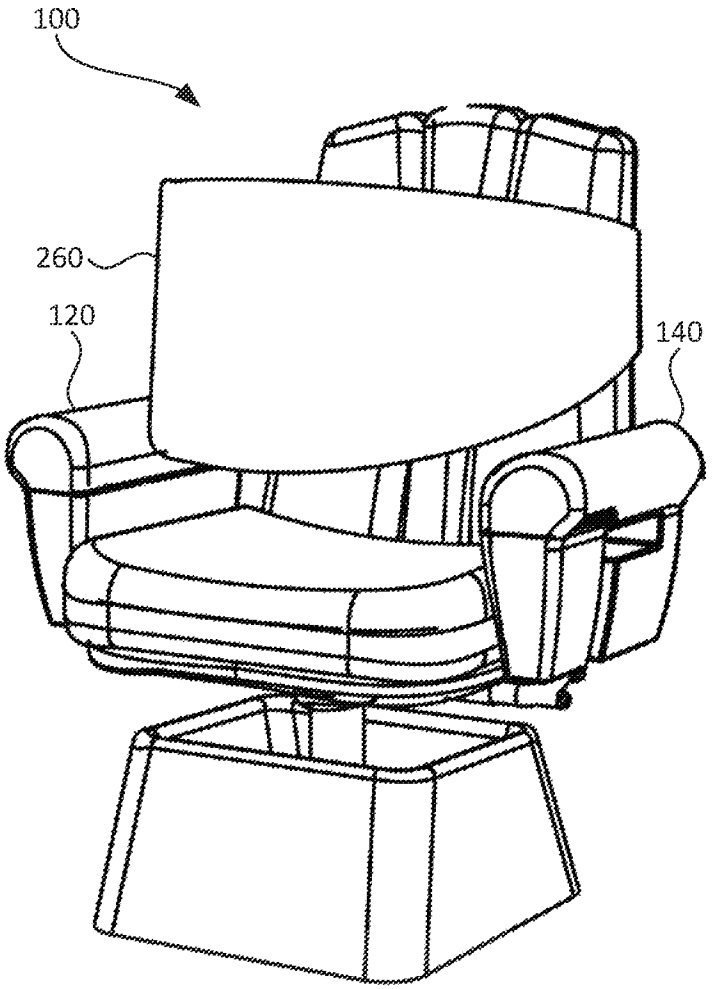
FIG. 16 illustrates a perspective view of the chair of the system of FIG. 1 with a privacy screen in a privacy position.
Figure 18:
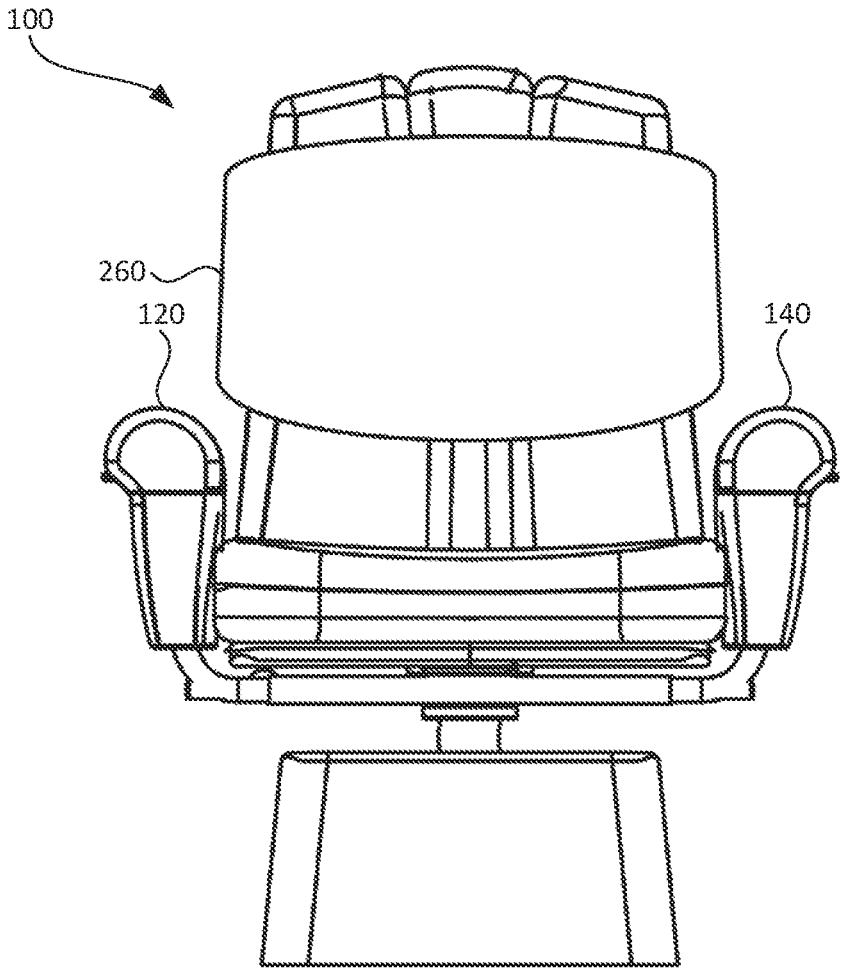
FIG. 18 illustrates a front view of the chair of FIG. 16 with the privacy screen in the privacy position.

Referring to FIG. 15, to facilitate movement of the upper portion 210 relative to the lower portion 215, the first armrest portion 120 includes a first track 230 coupled to the lower portion 215, a first slider 235 that translates along the first track 230 in the first direction 220, a second track 240 coupled to the first slider 235 opposite the first track 230, and a second slider 245 that translates along the second track 240 in the second direction 225, the second slider 245 coupling to the upper portion 210 opposite the second track 240.

Referring again to FIGS. 11-14, in the retracted position the second armrest portion 140 is generally disposed even with and below the seat portion 110 to facilitate entry to and egress from the seat portion 110. To facilitate movement of the second armrest portion 140 from the retracted position to the normal position and vice versa, a second support 250, which couples the second armrest portion 140 to the base portion 110, is pivotable relative to the seat portion 110 about a third axis 255 (for example, by about 90 degrees). The seat portion 110 and/or the second support 250 may include a locking mechanism (not shown) that is normally engaged to inhibit the second support 250 and the second armrest portion 140 from pivoting relative to the seat portion 110 about the third axis 255 and selectively disengageable to permit movement from the normal position to the retracted position and vice versa.

Although it is not specifically illustrated, the second armrest portion 140 may similarly occupy various third, or adjustments, positions and include similar components to facilitate moving to and from such positions. Although it is not specifically illustrated, the first armrest portion 120 may similarly occupy a fourth, or retracted, position and include similar components to facilitate moving to and from such position.

Figure 20:
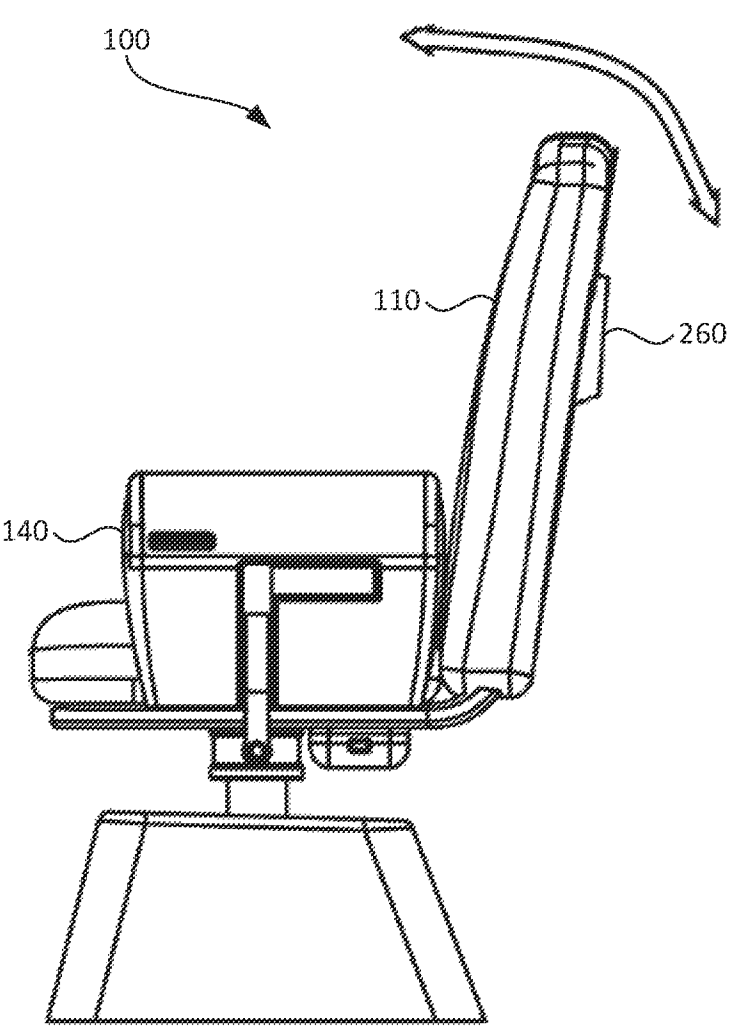
FIG. 20 illustrates a side view of the chair of FIG. 16 with the privacy screen in a retracted position.
Figure 19:
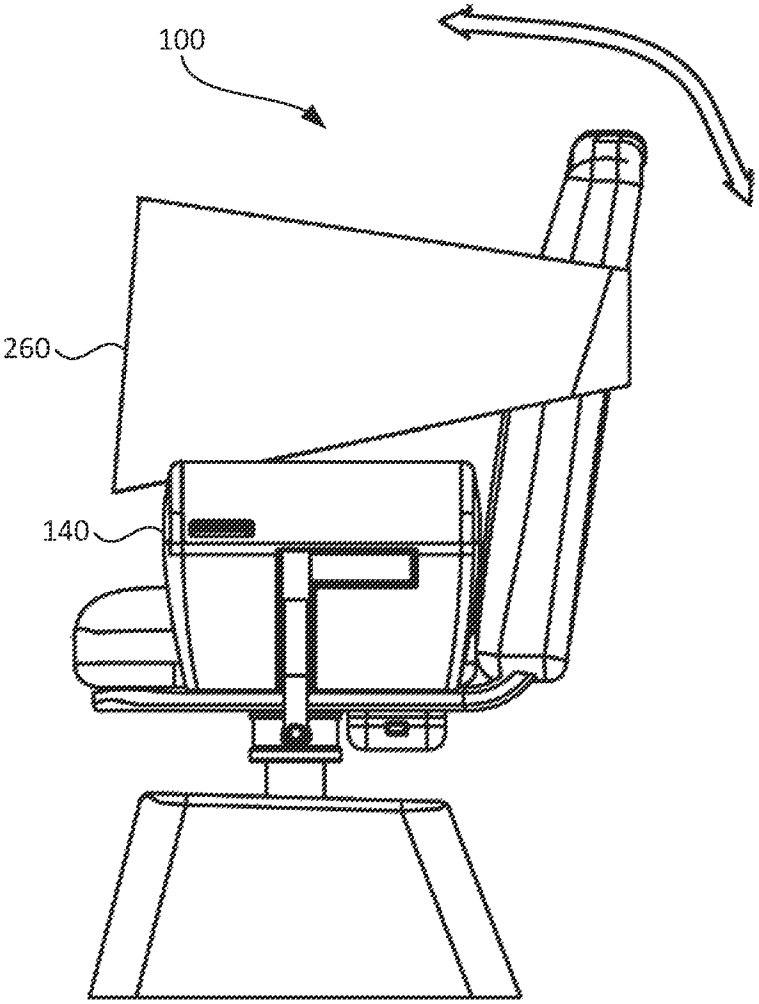
FIG. 19 illustrates a side view of the chair of FIG. 16 with the privacy screen in the privacy position.

In some embodiments and as illustrated in FIGS. 16-20, the chair 100 further includes a retractable privacy screen 260. FIGS. 16-19 illustrate the privacy screen 260 in a use, or "privacy", position in which the privacy screen 260 may obscure an infant and a mother during breastfeeding. FIG. 20 illustrates the privacy screen 260 in a retracted position in which the privacy screen 260 is disposed completely behind the seat portion 110. The privacy screen 260 may move from the privacy position to the retracted position by pivoting over the seat portion 110 and collapsing upon itself. Similarly, the privacy screen 260 may move from the retracted position to the privacy position by pivoting over the seat portion 110 and expanding. Although it is not specifically illustrated, one or both of the first armrest portion 120 and the second armrest portion 140 may occupy an infant support position while the privacy screen 260 is in the privacy position.

In some embodiments, the nursing chair system 50 includes additional features that facilitate ease-of-use and/or convenience. In some embodiments, one or both of the first armrest portion 120 and the second armrest portion 140 may include storage space 265 (see FIG. 10) for holding, for example, two or three bottles. The storage space 265 may be a 'cold' storage space 265 cooled by a refrigeration unit (not shown) and/or by including reusable cold packs (not shown) within the storage space 265. In some embodiments, the nursing chair system 50 may include one or more antimicrobial materials and/or linings, particularly for the storage space 265. In some embodiments, the nursing chair system 50 may include soft LED lighting (not shown) in the sides of the chair 100 to facilitate late night feedings. In some embodiments, the nursing chair system 50 may include an infant scale (not shown) that slides in and out near the pedestal portion 105 for weighted feedings. In some embodiments, the nursing chair system 50 may include one or more power outlets, USB ports, and/or other like electronic connections at the pedestal portion 105 and/or side(s) of the chair 100 to facilitate, for example, charging phones, plugging in a nursing pump, or the like. In some embodiments, the nursing chair system 50 may include one or more spill- and stain-proof material for any of the seat portion 110, the back portion 130, armrest portions 120, 140, and the footrest 150.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

Moreover, though the description of the disclosure has included description of one or more aspects, embodiments, or configurations and certain variations and modifications, other variations, combinations, and modifications are within the scope of the disclosure, for example, as may be within the skill and knowledge of those in the art, after understanding the present disclosure. It is intended to obtain rights which include alternative aspects and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A chair for supporting an infant while breastfeeding from a mother seated in the chair, comprising:

a seat portion configured to support the mother;

a back portion coupled to the seat portion; and an adjustable armrest portion coupled to the seat portion, the adjustable armrest portion being movable from a normal position to an infant supporting position and vice versa relative to the seat portion, in the normal position an upper surface of the adjustable armrest portion being configured to support an arm of the mother and a side surface of the adjustable armrest portion adjacent the upper surface facing the seat portion, and in the infant supporting position the side surface of the adjustable armrest portion being pivoted upwardly relative to the normal position and thereby configured to support the infant.

2. The chair of claim 1, wherein the adjustable armrest portion is movable from the normal position to the infant supporting position by pivoting about a first axis and a second axis substantially perpendicular to the first axis.

3. A chair for supporting an infant while breastfeeding from a mother seated in the chair, comprising:

a seat portion configured to support the mother;

a back portion coupled to the seat portion; and an adjustable armrest portion coupled to the seat portion, the adjustable armrest portion being movable from a normal position to an infant supporting position and vice versa relative to the seat portion, in the normal position an upper surface of the adjustable armrest portion being configured to support an arm of the mother, and in the infant supporting position a side surface of the adjustable armrest portion adjacent the upper surface being configured to support the infant;

wherein the adjustable armrest portion is movable from the normal position to the infant supporting position by pivoting about a first axis, pivoting about a second axis substantially perpendicular to the first axis, and translating along the first axis.

4. The chair of claim 1, wherein the adjustable armrest portion is movable from the normal position to the infant supporting position by pivoting about a first axis, pivoting about a second axis substantially perpendicular to the first axis, and translating along the second axis.

5. The chair of claim 1, wherein the adjustable armrest portion is movable from the normal position to the infant supporting position by pivoting about a first axis, pivoting about a second axis substantially perpendicular to the first axis, translating along the first axis, and translating along the second axis.

6. The chair of claim 1, further comprising a support coupling the adjustable armrest portion to the seat portion, the support facilitating movement of the adjustable armrest portion from the normal position to the infant supporting position and vice versa relative to the seat portion.

7. The chair of claim 1, wherein the adjustable armrest portion is further movable from the normal position to retracted position and vice versa relative to the seat portion, in the retracted position the adjustable armrest portion being disposed lower than in the normal position.

8. A chair for supporting an infant while breastfeeding from a mother seated in the chair, comprising:

a seat portion configured to support the mother;

a back portion coupled to the seat portion; and an adjustable armrest portion coupled to the seat portion, the adjustable armrest portion being movable from a normal position to an infant supporting position and vice versa relative to the seat portion, in the normal position an upper surface of the adjustable armrest portion being configured to support an arm of the mother, and in the infant supporting position a side surface of the adjustable armrest portion adjacent the upper surface being configured to support the infant, the adjustable armrest portion further comprising:

a lower portion; and an upper portion coupled to the lower portion and comprising the upper surface, the upper portion being movable relative to the lower portion in a first direction substantially perpendicular to the first axis.

9. The chair of claim 8, wherein the upper portion is further movable relative to the lower portion in a second direction substantially perpendicular to the first direction.

10. The chair of claim 1, wherein the adjustable armrest portion is a first adjustable armrest portion, and further comprising a second adjustable armrest portion coupled to the seat portion.

11. The chair of claim 10, wherein the normal position is a first normal position, the infant support position is a first infant support position, the upper surface is a first upper surface, and the side surface is a first side surface, and wherein the second adjustable armrest portion is movable from a second normal position to a second infant supporting position and vice versa relative to the seat portion, in the second normal position a second upper surface of the second adjustable armrest portion being configured to support an arm of the mother, and in the second infant supporting position a second side surface of the second adjustable armrest portion adjacent the second upper surface being configured to support the infant.

* * * * *